US008483593B2

(12) United States Patent
Okabe et al.

(10) Patent No.: US 8,483,593 B2
(45) Date of Patent: Jul. 9, 2013

(54) IMAGE FORMING DEVICE HAVING SPACER MEMBER FOR RETAINING DEVELOPING ROLLER AT POSITION SPACED AWAY FROM CORRESPONDING PHOTOSENSITIVE DRUM

(75) Inventors: Yasushi Okabe, Nagoya (JP); Junichi Hashimoto, Toyohashi (JP); Yoshiya Tomatsu, Kasugai (JP); Takashi Shimizu, Nagoya (JP)

(73) Assignee: Brother Kogyo Kabushiki Kaisha, Nagoya-shi (JP)

( * ) Notice: Subject to any disclaimer, the term of this patent is extended or adjusted under 35 U.S.C. 154(b) by 193 days.

(21) Appl. No.: 13/009,096

(22) Filed: Jan. 19, 2011

(65) Prior Publication Data

US 2011/0229194 A1 Sep. 22, 2011

(30) Foreign Application Priority Data

Mar. 19, 2010 (JP) ..... 2010-064155

(51) Int. Cl.
*G03G 15/00* (2006.01)

(52) U.S. Cl.
USPC ..... 399/110

(58) Field of Classification Search
USPC ..... 399/110, 111, 113, 119, 411
See application file for complete search history.

(56) References Cited

U.S. PATENT DOCUMENTS 6,453,136 B1 9/2002 Yasumaru
7,215,905 B2 5/2007 Kamimura
7,272,339 B2 9/2007 Tsuzuki et al.
7,663,658 B2 2/2010 Murano et al.
7,697,866 B2 4/2010 Murayama
7,860,433 B2 12/2010 Toba et al.
8,208,830 B2 6/2012 Uratani et al.
2003/0185587 A1* 10/2003 Kawai et al. ..... 399/111
2004/0175203 A1 9/2004 Kamimura (Continued)

FOREIGN PATENT DOCUMENTS

CN 1892467 A 1/2007
CN 101114145 A 1/2008

(Continued)

OTHER PUBLICATIONS

US Office Action mailed Jan. 16, 2013, U.S. Appl. No. 13/009,003.

(Continued)

*Primary Examiner* — Walter L Lindsay, Jr.
*Assistant Examiner* — Billy J Lactaoen
(74) *Attorney, Agent, or Firm* — Banner & Witcoff, Ltd.

(57) ABSTRACT

A holder unit is configured to hold a plurality of photosensitive drums such that the plurality of photosensitive drums are arrayed in a predetermined direction and juxtaposed with each other with a space between neighboring photosensitive drums. A plurality of developing units is held by the holder unit, each is provided in association with each photosensitive drum, and each includes a developing roller displaceable between a contact position where the developing roller is in contact with the photosensitive drum and a spaced position where the developing roller is spaced away from the photosensitive drum. A spacer member has a plurality of retaining portions each in association with each developing unit and configured to retain each developing unit at the spaced position, and a linking portion integral with the retaining portions and configured to connect neighboring retaining portions therethrough in the predetermined direction.

9 Claims, 12 Drawing Sheets

U.S. PATENT DOCUMENTS

| | | | | |
|---|---|---|---|---|
| 2006/0245784 | A1 | 11/2006 | Tsuzuki et al. | |
| 2007/0036582 | A1 | 2/2007 | Okabe | |
| 2007/0071495 | A1 | 3/2007 | Hashimoto et al. | |
| 2007/0201900 | A1 | 8/2007 | Murayama | |
| 2008/0253800 | A1 | 10/2008 | Uratani et al. | |
| 2008/0260423 | A1 | 10/2008 | Murakami | |
| 2009/0003875 | A1 | 1/2009 | Toba et al. | |
| 2009/0003876 | A1 * | 1/2009 | Maeshima et al. | 399/111 |
| 2010/0021203 | A1 | 1/2010 | Nishimura et al. | |
| 2011/0229193 | A1 | 9/2011 | Okabe et al. | |

FOREIGN PATENT DOCUMENTS

| | | | |
|---|---|---|---|
| JP | 2002-277796 | A | 9/2002 |
| JP | 2005-025080 | A | 1/2005 |
| JP | 2006-259448 | | 9/2006 |
| JP | 2006-308755 | A | 11/2006 |
| JP | 2006-330481 | | 12/2006 |
| JP | 2007-072422 | A | 3/2007 |
| JP | 2007-232933 | A | 9/2007 |
| JP | 2008-262088 | A | 10/2008 |
| JP | 2009-031770 | A | 2/2009 |
| JP | 2009-031771 | A | 2/2009 |
| JP | 2010-026299 | A | 2/2010 |
| JP | 2010-054836 | A | 3/2010 |

OTHER PUBLICATIONS

CN Office Action mailed Apr. 22, 2013, CN App No. 201110072874.4, English translation.

CN Office Action mailed May 6, 2013, CN App No. 201110063526.0, English translation.

* cited by examiner

IMAGE FORMING DEVICE HAVING SPACER MEMBER FOR RETAINING DEVELOPING ROLLER AT POSITION SPACED AWAY FROM CORRESPONDING PHOTOSENSITIVE DRUM

CROSS REFERENCE TO RELATED APPLICATION

This application claims priority from Japanese Patent Application No. 2010-064155 filed on Mar. 19, 2010. The entire content of each of these priority applications is incorporated herein by reference. The present application is closely related to a co-pending U.S. Patent Application (corresponding to Japanese Patent Application No. 2010-064154 filed on Mar. 19, 2010).

TECHNICAL FIELD

The present invention relates to an image forming device such as a laser printer.

BACKGROUND

In one conventional type of a laser printer, a developing unit is provided detachably from a main frame. In such laser printer the developing unit has already been assembled to the main frame to reduce a packaging size for the purpose of transportation. However, with such an assembled state, a developing roller of the developing unit is in contact with a photosensitive drum provided in the main frame. As a result, a surface of the photosensitive drum is damaged due to frictional contact with the developing roller if vibration is imparted on the laser printer during transportation.

Japanese Patent Application Publication No. 2006-330481 discloses a laser printer for protecting the photosensitive drum from damage against a charging roller during transportation. To this effect, a spacer member is provided to position the charging roller away from the photosensitive drum. More specifically, the charging roller is urged toward the photosensitive drum by an urging force of a spring. The charging roller has a bearing member formed with an engagement recess with which the spacer member is to be engaged. If the spacer member is engaged with the recess, the bearing member is moved away from the photosensitive drum along with the charging roller against the urging force of the spring. Thus, the charging roller can be spaced away from the photosensitive drum.

SUMMARY

The above-described conventional structure may be applied to a space between the photosensitive drum and the developing roller for the transportation of the laser printer. However, a user must remove the spacer member for the beginning of use. In case of a color printer, a plurality of spacer members whose numbers correspond to the numbers of a plurality of photosensitive drums must be provided and detached. This is troublesome.

It is therefore an object of the invention to provide an image forming device capable of facilitating removal of the spacer member while preventing the surface of the photosensitive drum from being damaged.

This and other objects of the present invention will be attained by an image forming device including: a plurality of photosensitive drums, a holder unit, a plurality of developing units, and a spacer member. The holder unit is configured to hold the plurality of photosensitive drums such that the plurality of photosensitive drums are arrayed in a predetermined direction and juxtaposed with each other with a space between neighboring photosensitive drums. The plurality of developing units is held by the holder unit, each is provided in association with each photosensitive drum, and each includes a developing roller displaceable between a contact position where the developing roller is in contact with the photosensitive drum and a spaced position where the developing roller is spaced away from the photosensitive drum. The spacer member has a plurality of retaining portions each in association with each developing unit and configured to retain each developing unit at the spaced position, and a linking portion integral with the retaining portions and configured to connect neighboring retaining portions therethrough in the predetermined direction.

DETAILED DESCRIPTION

Figure 1:
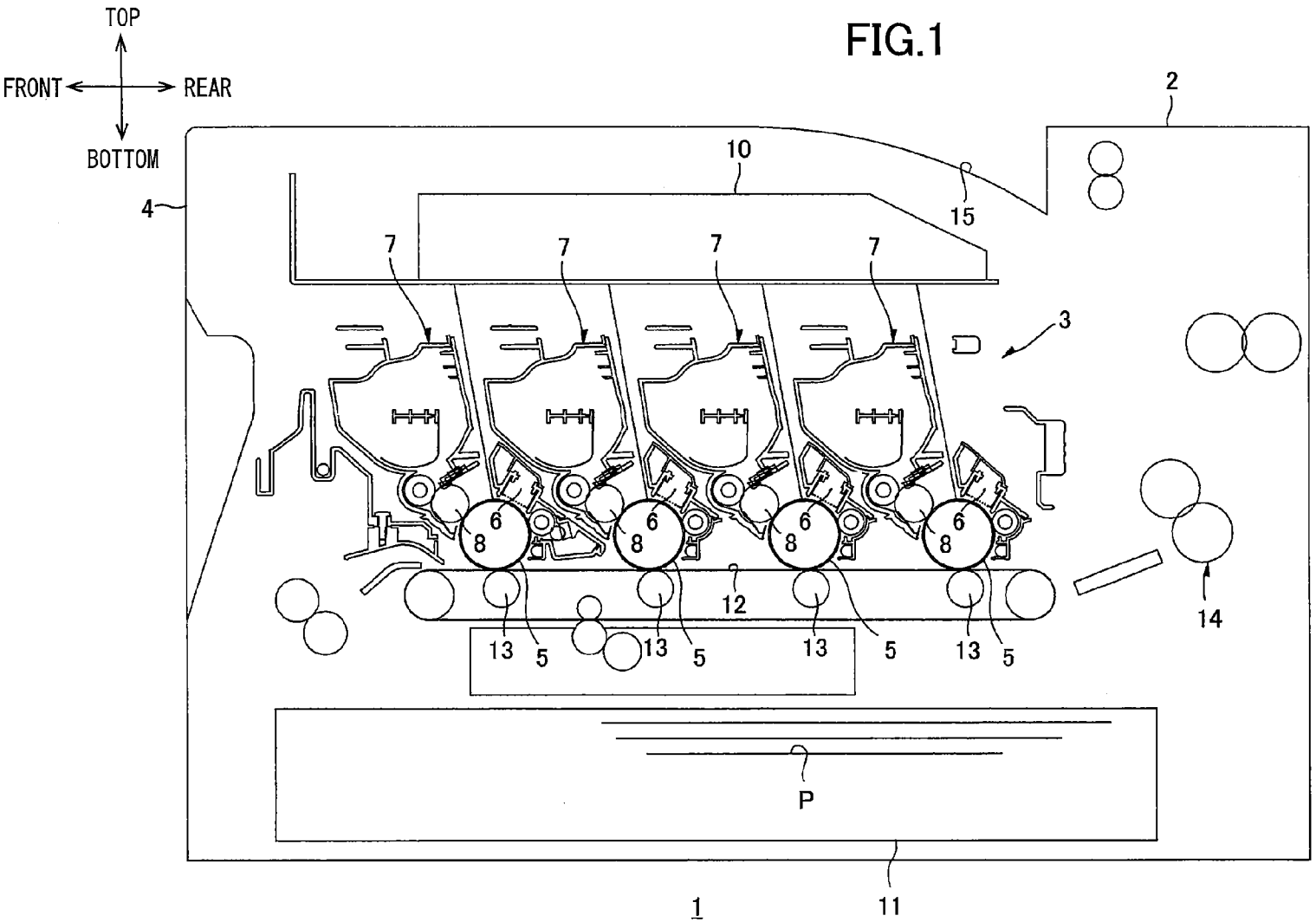
FIG. 1 is a cross-sectional side view of a printer according to one embodiment of the present invention.

An image forming device according to one embodiment of the invention will be described with reference to FIGS. 1 through 12 where a tandem type color printer 1 is shown.

1. General Structure of the Printer

The printer 1 has a main body casing 2 formed with a front opening opened or closed by a front cover 4. A drum unit 3 as a holder unit is provided in the main body casing 2 and detachable therefrom by opening the front cover 4. In the following description, a side of the front cover 4 will be referred to as "front side", and a side opposite to the front cover 4 will be referred to as "rear side". Further, the terms "right side" and "left side" will be used when viewed from the printer 1 from the front side. Further, the term "lateral" or "laterally" will be used which indicates a direction between the right side and the left side.

The drum unit 3 includes four photosensitive drums 5 for the colors of black, yellow, magenta and cyan and arrayed in the frontward/rearward direction in this order of colors. In the drum unit 3, a scorotron charger 6 and a developer cartridge 7 as a developing unit are provided for each photosensitive drum 5. The developer cartridge 7 includes a developing roller 8 for supplying a toner (developer) to the photosensitive drum 5, and a toner case (casing) 60 (FIG. 2) having a box shape for accommodating therein the toner. The toner case 60 has a lower end formed with an opening through which a part of an outer peripheral surface of the developing roller 8 is exposed to an atmosphere. Each developer cartridge 7 is detachably assembled to the drum unit 3.

Above the drum unit 3, an exposure unit 10 is positioned for emitting four laser beams corresponding to four colors. In accordance with the rotation of the photosensitive drum 5, the surface of the photosensitive drum 5 is uniformly charged by electrical charge from the scorotron charger 6. Then, the surface of the photosensitive drum 5 is selectively exposed to laser beams from the exposure unit 10. Upon exposure, electrical charge on the surface of the photosensitive drum 5 is selectively erased to provide an electrostatic latent image on the surface of the photosensitive drum 5. Then, the toner is supplied to the electrostatic latent image from the developing roller 8 thereby forming a toner image corresponding to the latent image on the surface of the photosensitive drum 5. Incidentally, four LED arrays can be provided for the photosensitive drums 5 instead of the exposure unit 10.

A sheet cassette 11 is provided at a bottom portion of the main body casing 2 for accommodating therein a stack of cut sheets P, and a conveyer belt 12 is provided immediately below the four photosensitive drums 5. Transfer rollers 13 are positioned in confrontation with the photosensitive drums 5 interposing the conveyer belt 12 therebetween. A sheet P on the sheet cassette 11 is conveyed onto the conveyer belt 12 through feed rollers (not shown), and the sheet P on the conveyer belt 12 is moved past the respective photosensitive drum 5 because of the running of the conveyer belt 12. Therefore, each toner image on each photosensitive drum 5 is transferred onto the sheet P because of the transfer bias applied to each transfer roller 13.

A fixing unit 14 is provided at a position downstream of the conveyer belt 12 in a sheet feeding direction. The sheet P carrying a toner image is conveyed to the fixing unit 14, where the toner image is thermally and pressurizingly fixed to the sheet P. A discharge tray 15 is provided downstream of the fixing unit 14 and at an upper surface of the main body casing 2. Image fixed sheet P is discharged onto the discharge tray 15 by way of discharge rollers (not shown).

2. Drum Unit

Figure 2:
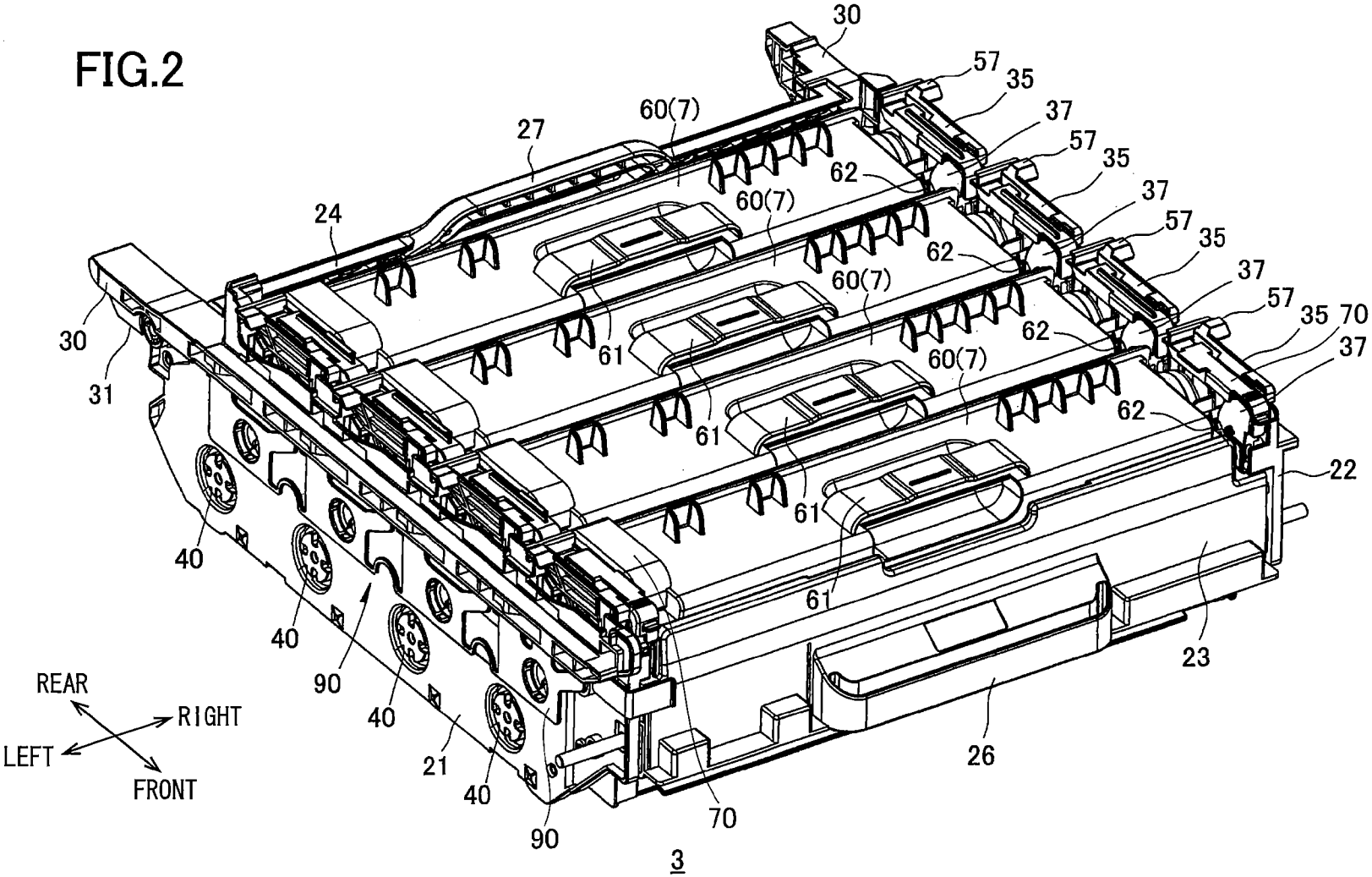
FIG. 2 is a perspective view of a drum unit of the printer as viewed from upper left.
Figure 3:
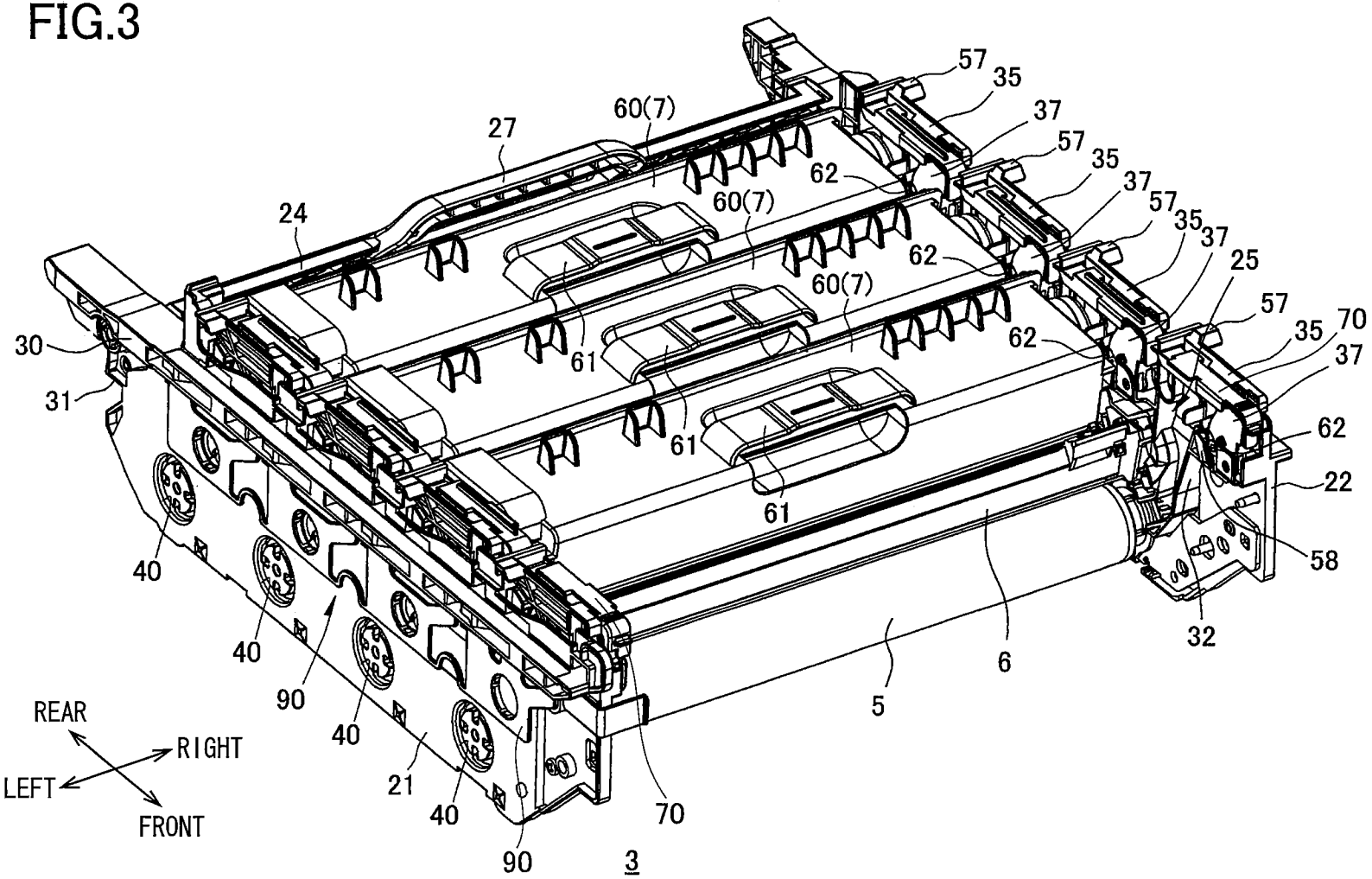
FIG. 3 is a perspective view of the drum unit as viewed from upper left, but a frontmost developing cartridge and a front beam are eliminated for simplicity.

As shown in FIG. 2, the drum unit 3 includes a first side plate 21 extending in the frontward/rearward direction, a second side plate 22 confronting the first side plate 21 with a space therefrom in the lateral direction, a front beam 23 extending in the lateral direction and connecting a front end portion of the first side plate 21 to a front end portion of the second side plate 22, and a rear beam 24 extending in the lateral direction and connecting a rear end portion of the first side plate 21 to a rear end portion of the second side plate 22. As shown in FIG. 3, four photosensitive drums 5 are juxtaposed to each other at an equal interval in a space between the front beam 23 and the rear beam 24. Each photosensitive drum 5 has a drum shaft rotatably supported to the first and second side plate 21 and 22.

Each scorotron charger 6 is positioned at a rear side of each photosensitive drum 5 and is nipped between the first side plate 21 and second side plate 22. Each mount position 25 is defined in front of each photosensitive drum 5 for detachably mounting each developer cartridge 7.

(1) Front Beam

As shown in FIG. 2, a front hand grip 26 is provided integrally with the front beam 23 at a laterally intermediate portion thereof. The front hand grip 26 has a U-shaped in plan view whose arm ends are connected to the front beam 23 and a bottom of the U-shaped front hand grip 26 is positioned frontward of the front beam 23. That is, the front hand grip 26 protrudes frontward from the front beam 23.

(2) Rear Beam

A rear hand grip 27 is provided integrally with the rear beam 24 at a laterally intermediate portion thereof. The rear hand grip 27 has a U-shaped in a rear view whose arm ends are connected to the rear beam 24 and a bottom of the U-shaped rear hand grip 27 is positioned diagonally above the rear beam 24 and toward the front beam 23. That is, the rear hand grip 27 protrudes diagonally upward and frontward from the rear beam 24.

In the open state of the front cover 4, a user grips the front hand grip 26 and slidingly pulls the drum unit 3 frontward relative to the main body casing 2 until the rear beam 24 is positioned to a front end portion of the main body casing 2. Then, the user grips both the front hand grip 26 and rear hand grip 27 to carry the drum unit 3 away from the main body casing 2.

(3) A Pair of Side Plates

Figure 5:
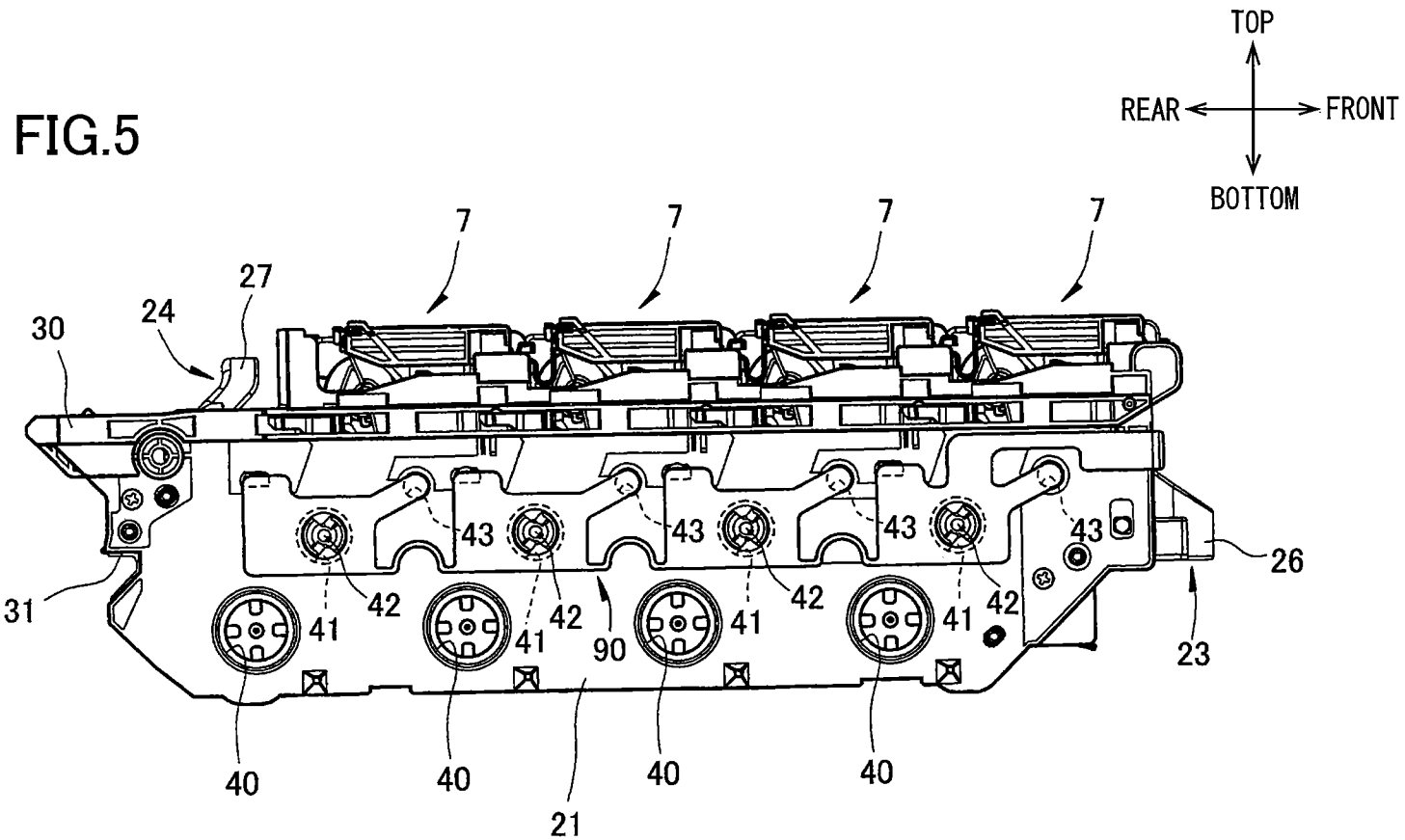
FIG. 5 is a left side view of the drum unit according to the embodiment.
Figure 6:
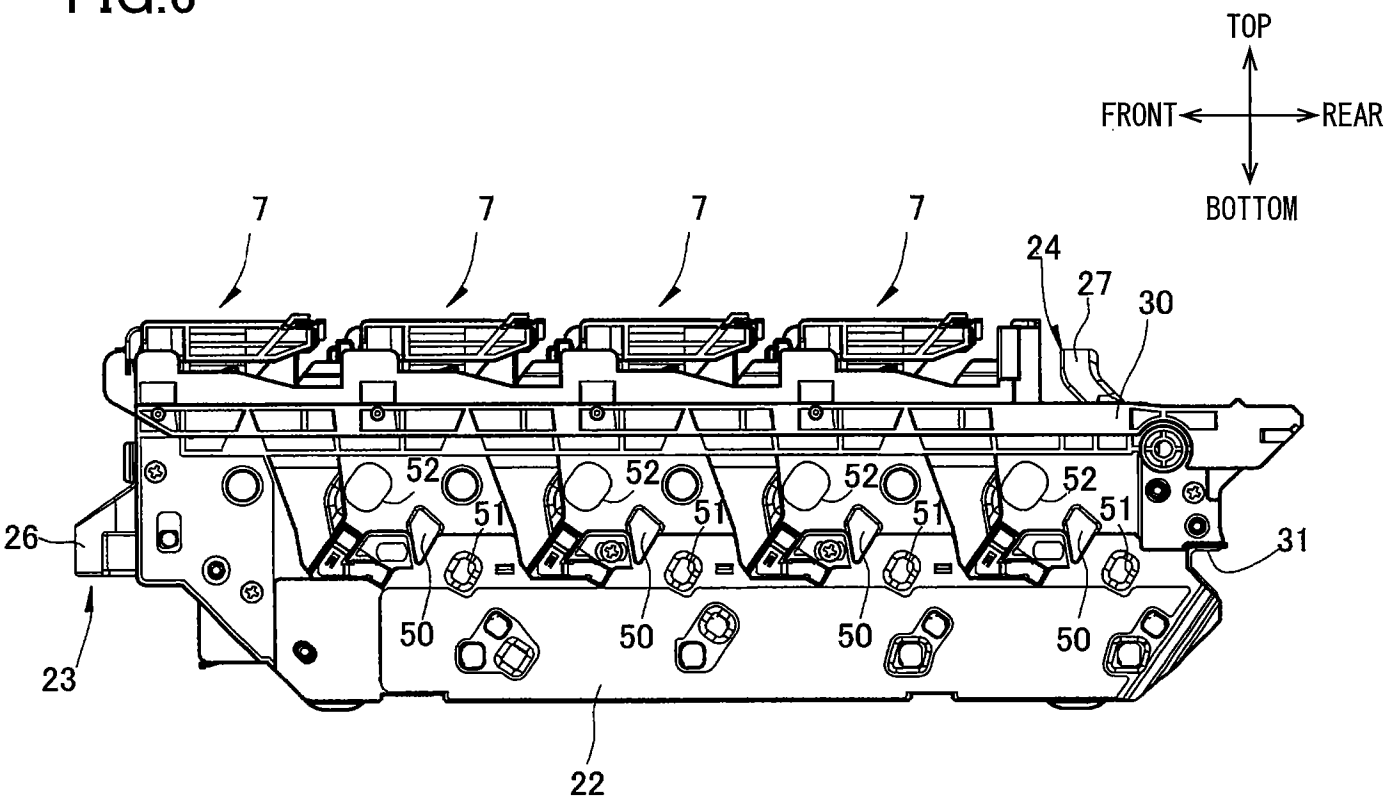
FIG. 6 is a right side view of the drum unit according to the embodiment.

The first and second side plates 21 and 22 are made from a fiber reinforced plastic material. Each side plate has an elongated rectangular shape extending in frontward/rearward and vertical directions as shown in FIGS. 5 and 6. The front and rear end portions of the first side plate 21 are positioned leftward of the front and rear beams 23, 24, and the front and rear end portions of the second side plate 22 are positioned rightward of the front and rear beams 23, 24.

Each of the first and second side plates 21, 22 has an upper end portion provided with a flange 30 extending in frontward/rearward direction and protruding laterally outwardly. The flange 30 is adapted to be mounted on rollers provided inside the main body casing 2, and is slidingly moved over the rollers, thereby facilitating pull-out and push-in movement of the drum unit 3 with respect to the main body casing 2.

Further, the rear end portion of each of the first and second side plates 21, 22 is formed with a notched portion 31 having a triangular shape. A reference shaft (not shown) is provided inside the main body casing 2. Upon complete loading of the drum unit 3 in the main body casing 2, the notched portion 31 receives the reference shaft, whereupon the drum unit 3 is accurately positioned in the main body casing 2 in frontward/rearward direction and vertical direction.

Figure 7:
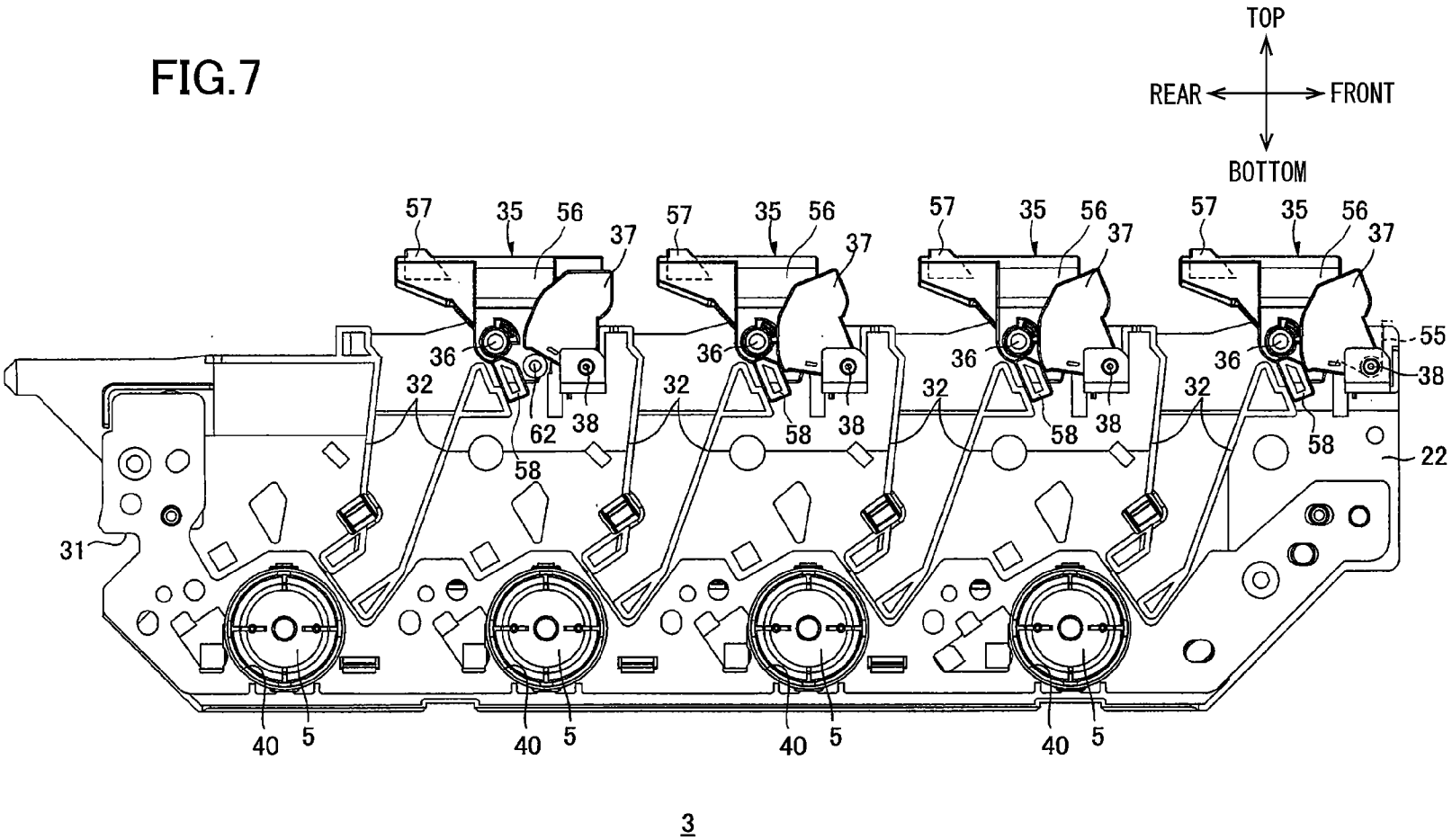
FIG. 7 is a side view particularly showing a second side plate, pressure levers and separation levers in the drum unit according to the embodiment.

Further, as shown in FIGS. 3 and 7, four cartridge guide portions 32 are provided at each inner surface of each side plate 21, 22 for guiding movement of each developer cartridge 7 toward and away from the mount position 25 positioned between the first and second side plates 21 and 22. These cartridge guide portions 32 are arrayed in the frontward/rearward direction with a constant interval between neighboring cartridge guide portions 32. Each cartridge guide portion 32 is constituted by two ribs protruding laterally inwardly from each side plate 21, 22 and spaced away from each other in the frontward/rearward direction. Each cartridge guide portion 32 is slanted rearward at a constant gradient from each upper end portion of each side plate 21, 22 toward each lower end portion of each side plate 21, 22. Each cartridge guide portion 32 has a lower end portion extending in a direction parallel to an imaginary line connecting a center of the photosensitive drum 5 and a center of the developing roller 8 (see FIG. 1) and is open toward the photosensitive drum 5.

As shown in FIG. 7, four separation levers 35 are provided at each inner surface and upper end portion of each side plate 21, 22. These separation levers 35 are arrayed in the frontward/rearward direction with a constant space between neighboring levers. Four first pivot shafts 36 protrude laterally inwardly from each side plate 21, 22 for pivotally movably supporting four separation levers 35.

Further, as shown in FIG. 7, four pressure levers 37 are provided at each inner surface and upper end portion of each side plate 21, 22 at positions ahead of respective separation levers 35. Four second pivot shaft 38 protrude laterally inwardly from each side plate 21, 22 for pivotally movably supporting four pressure levers 37.

(3-1) First Side Plate 21

Figure 4:
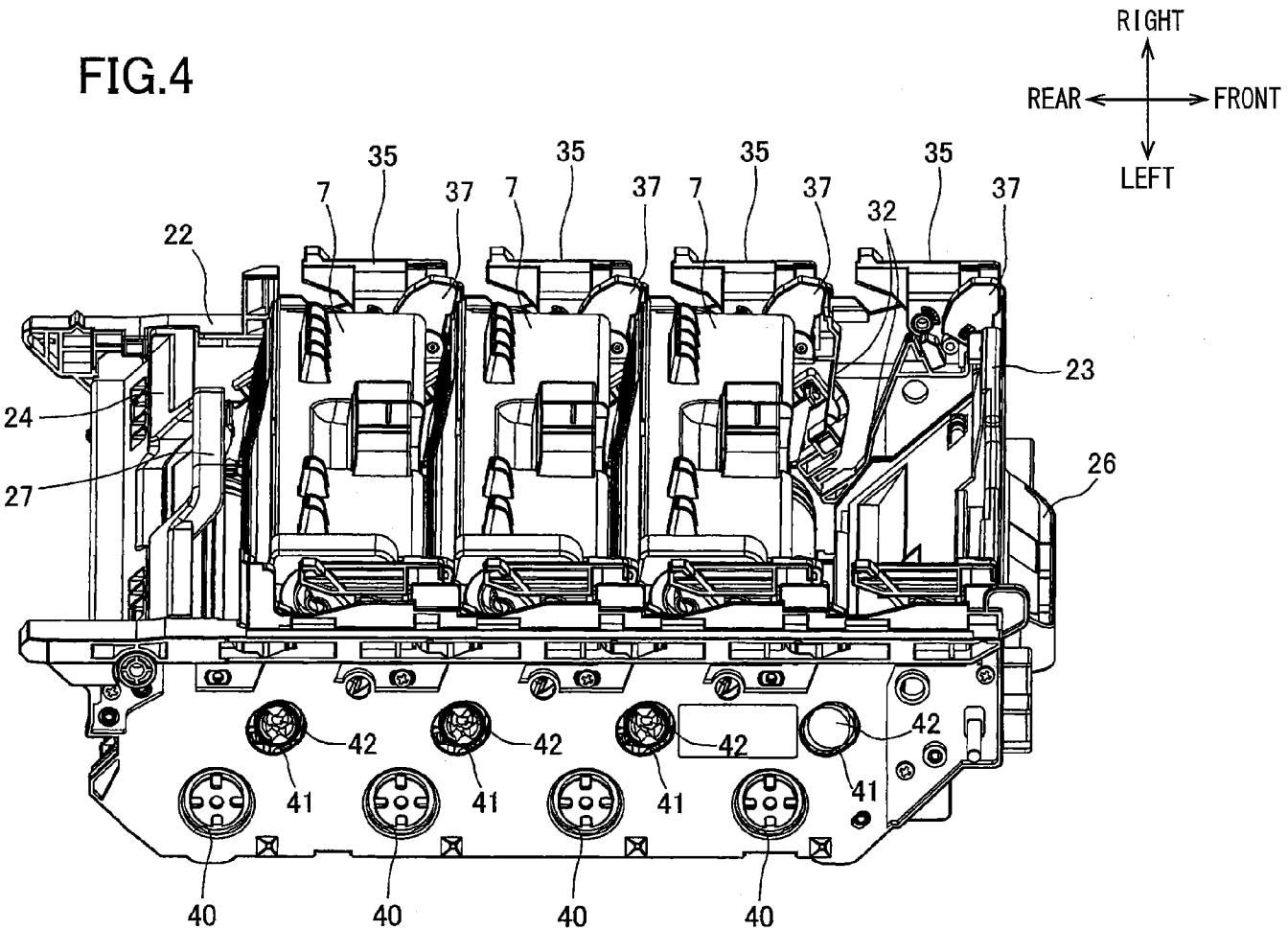
FIG. 4 is a perspective view of the drum unit shown in FIG. 2 as viewed from the left, and showing a state where a fixing member is removed from the drum unit.

As shown in FIGS. 4 and 5, the lower end portion of the first side plate 21 is formed with four drum coupling insertion holes 40 arrayed in frontward/rearward direction for exposing each left end face of each photosensitive drum 5. The drum coupling insertion holes 40 extend through a thickness of the first side plate 21 and have a cylindrical shape.

Further, four developer coupling insertion holes 41 (functioning as opening portions) are formed in the first side plate 21 at positions diagonally frontward and upward of the respective drum coupling insertion holes 40. Each developer coupling insertion hole 41 extends through the thickness of the first side plate 21 and an elongated slot shape such as elliptical shape or oblong shape whose major axis extends in a radial direction of each drum coupling insertion hole 40. In a state where the developer cartridge 7 is assembled between the pair of side plates 21 and 22 (the developer cartridge 7 is at the mount position 25), each developer coupling 42 provided at each left end portion of each developer cartridge 7 is inserted into each developer coupling insertion hole 41.

Four light transmission holes 43 are formed at the upper end portion of the first side plate 21. Each light transmission hole 43 is positioned frontward and above each developer coupling insertion hole 41.

(3-2) Second Side Plate

As shown in FIG. 6, the second side plate 22 is formed with four charge electrode passing holes 50 and four light passing holes 51, and is provided with four developer electrodes 52.

Each charge electrode passing hole 50 is positioned rearward of each lower end portion of each cartridge guide portion 32. Each charge electrode passing hole 50 is in confrontation with each charge electrode for supplying electric power to a grid electrode of the scorotron charger 6.

Each light passing hole 51 is positioned rearward and diagonally downward of each charge electrode passing hole 50. Four erase lamps (not shown) for erasing electrical charge on the surfaces of the photosensitive drums 5 are provided in the main body casing 2. In a state where the drum unit 3 is assembled to the main body casing 2, each erase lamp is positioned laterally outside of each light passing hole 51 in linear alignment therewith. Erase light emitted from each erase lamp passes through each light passing hole 51 and is supplied to the surface of each photosensitive drum 5, thereby erasing residual electrical charge on the surface of the photosensitive drum 5.

Each developer electrode 52 is positioned rearward of each cartridge guide portion 32. In a state where each of the developer cartridge 7 is assembled to the drum unit 3, each developer electrode 52 is, in the lateral direction, in confrontation with each cartridge electrode (not shown) provided at one lateral end of each developer cartridge 7. The main body casing 2 is provided with main developer electrodes (not shown). Upon electrical connection of the developer electrodes 52 with the main developer electrodes, the cartridge electrodes can be electrically connected to the main developer electrodes.

(4) Pressure Lever

As shown in FIG. 7, each pressure lever 37 has generally triangular plate shape in side view, and has one apex portion through which the second pivot shaft 38 extending from each side plate 21, 22 is inserted, so that each pressure lever 37 is pivotally movable supported to the side plates 21, 22 through the second pivot shaft 38. Each pressure lever 37 extends diagonally upward and rearward from the one apex portion.

Further, as shown in broken line in FIG. 7, each pressure lever 37 is provided with a pressure spring 55 wound over the second pivot shaft 38. The pressure spring 55 is a torsion spring having one arm end engaged with each side plate 21, 22 and another arm end engaged with the pressure lever 37 so as to allow the pressure lever 37 to be pivotally moved about an axis of the second pivot shaft 38 in a counterclockwise direction in FIG. 7. Incidentally, the pressure spring 55 for the frontmost pressure lever 37 is only shown for simplicity. (The pressure springs 55 are provided for the respective pressure levers 37.)

(5) Separation Lever

The separation lever 35 has a main segment 56 having generally triangular plate shape in side view. Each main segment 56 has an upper edge extending in frontward/rearward direction, a front edge extending downward from a front end of the upper edge, and a rear edge extending diagonally upward from a lower end of the front edge to a rear end of the upper edge.

The first pivot shaft 36 extends through a rear intermediate portion of the main segment 56. Thus, the separation lever 35 is pivotally movably supported to the side plate 21, 22 through the first pivot shaft 36.

An abutment portion 57 is provided at a rear upper end portion of the main segment 56. The abutment portion 57 protrudes laterally outward from the main segment 56 and has a trapezoid shape in side view.

The separation lever 35 also includes an acting portion 58 protruding laterally inward from the lower rear end portion of the main segment 56. The acting portion 58 has generally rectangular shape in side view, and maintains slanting posture in which a lower edge of the acting portion 58 is positioned ahead of an upper edge of the acting portion 58 in the frontward/rearward direction.

The separation lever 35 is provided with an urging member (not shown), which is a torsion spring wound over the first pivot shaft 36 and having one arm end engaged with the side plate 21, 22 and another arm end engaged with the separation lever 35. Thus, the separation lever 35 is urged to be pivotally moved about an axis of the first pivot shaft 36 in a counterclockwise direction in FIG. 7.

3. Developer Cartridge (1) Structure of Developer Cartridge

As shown in FIG. 3, the developer cartridge 7 has a toner case 60 having a box shape. The toner case 60 has an upper wall provided with a hand grip 61 at a laterally intermediate portion thereof. The hand grip 61 has an inverted U-shape in front view connected to the upper wall of the toner case 60.

Each toner case 60 has side walls, and a boss (pressed portion) 62 laterally outwardly protrudes from each upper front end portion of each side wall. Further, a collar member (not shown) protrudes from each side wall of the toner case 60.

(2) Mounting Operation of the Developer Cartridge to Drum Unit

The developer cartridge 7 is mounted between the pair of side plates 21, 22 from above. In this case, each collar member protruding from each side wall of the toner case 60 is introduced into the cartridge guide portion 32 from above. The developer cartridge 7 is displaced downward while the collar member is guided by the cartridge guide portion 32. As shown in FIG. 1, further movement of the developer cartridge 7 is restricted when the developing roller 8 is brought into contact with the photosensitive drum 5. Thus, the developing roller 8 is positioned at a given position relative to the photosensitive drum 5.

Thereafter, the developer cartridge 7 is slightly tilted frontward, so that the boss 62 passes through a gap between the pressure lever 37 and the acting portion 58 of the pressure lever 37 and drives under or undercuts the pressure lever 37. In this instance, the pressure lever 37 is lifted upward against the biasing force of the pressure spring 55, and as a result, the developer cartridge 7 is urged downward. In this case, the acting portion 58 of the pressure lever 37 is at a spaced position (second position) slightly spaced away from the boss 62.

3. Separating and Pressing Operation

Direct acting type cams (not shown) slidably movable in the frontward/rearward direction are provided in the main body casing 2. Each direct acting type cam is positioned at its frontmost position within its movable range when the drum unit 3 is assembled in the main body casing 2.

In this state, as shown in FIG. 1, each developer cartridge 7 is at its contacting position where each developing roller 8 and each photosensitive drum 5 are in contact with each other. Each pressure lever 37 is in contact with each boss 62 of each developer cartridge 7 from above to press each boss 62 downward.

Each direct acting type cam is brought into contact with each front side of each abutment portion 57 of each separation lever 35 as a result of rearward displacement of the direct acting type cam. If the direct acting type cam is further moved rearward, the abutment portion 57 is pressed rearward and diagonally downward by the cam, so that the separation lever 35 is pivotally moved about the first pivot shaft 36 to move the acting portion 58 upward. In this pivotal movement of the separation lever 35, the acting portion 58 is brought into contact with the boss 62 from below to push the boss 62 upward. Accordingly, each developer cartridge 7 is lifted upward against the pressing force from the pressure lever 37. In this state, each developing roller 8 of each developer cartridge 7 is largely spaced away from the photosensitive drum 5 at a spaced position. Further, each separation lever 35 is at a pressing position (first position) for pressing the boss 62 to move the developer cartridge 7 away from the photosensitive drum 5.

4. Spacer Member

As shown in FIG. 3, in the drum unit 3, right and left spacer members 70 are provided at the first and second side plates 21 and 22, respectively.

(1) Structure of the Spacer Member 70

Figure 8A:
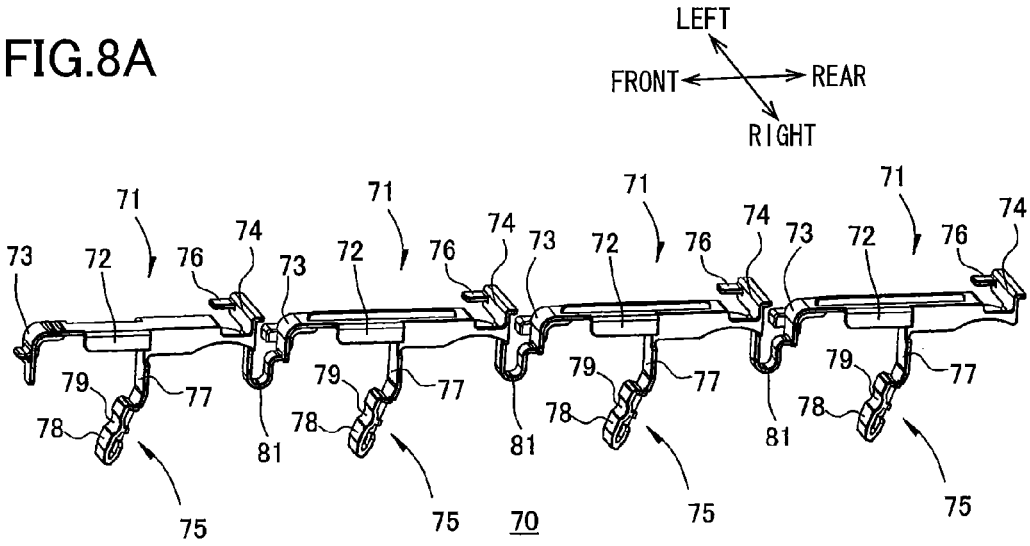
FIG. 8A is a perspective view of a left spacer member according to the embodiment.
Figure 8B:
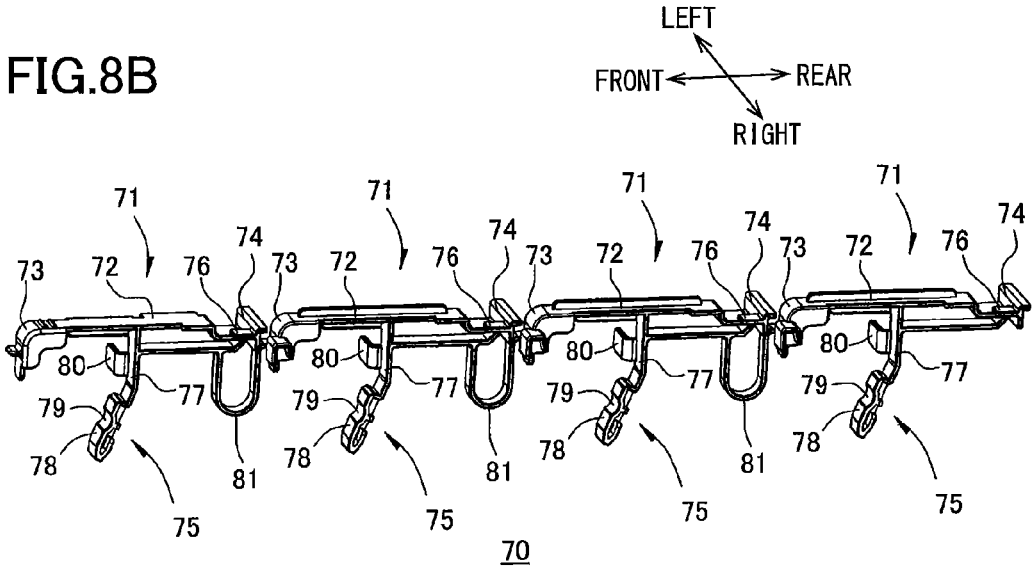
FIG. 8B is a perspective view of a right spacer member according to the embodiment.

The spacer member 70 is made from a flexible resin material. As shown in FIGS. 8A and 8B, the spacer member 70 has four retaining portions 71 spaced away from each other in the frontward/rearward direction. Further, a linking portion 81 is provided between neighboring retaining portions 71. Thus, integral spacer member 70 including the four retaining portions 71 and three linking portions 81 are provided.

(1-1) Retaining Portion 71

Each retaining portion 71 includes a main body section 72, a pressure lever regulating section 73, a separation lever regulating section 74, and a spacer section 75. The main body section 72 is of an elongated configuration extending in the frontward/rearward direction. The pressure lever regulating section 73 is integrally connected to a front end portion of the main body section 72 and is bent downward to have an L-shape in a side view.

The separation lever regulating section 74 is integrally connected to a rear end portion of the main body section 72 and extends laterally inwardly in a rod shape. The separation lever regulating section 74 is provided with a drop-out preventing section 76 protruding frontward from a free end portion thereof.

The spacer section 75 has a suspended portion 77 and a spacer body 78 integrally therewith. The suspended portion 77 extends downward from a longitudinally intermediate portion of the main body section 72, and the spacer body 78 extends diagonally downward and frontward from a lower end portion of the suspended portion 77. The spacer body 78 has a front end face formed with an arcuate recessed portion 79.

Further, as shown in FIG. 8B, a restraining portion 80 is provided at the suspended portion 77 of the spacer section 75. The restraining portion 80 protrudes frontward from the suspended portion 77 and is then bent laterally inwardly to have an L-shape in plan view.

(1-2) Linking Portion 81

As shown in FIGS. 8A and 8B, the linking portion 81 is positioned between the neighboring retaining portions 71 and has a top opened U-shaped configuration in side view. In FIG. 8A, in the left side spacer member 70, one end portion of the linking portion 81 is connected to the separation lever regulating section 74 provided at the rear end portion of the front side retaining portion 71, and another end portion of the linking portion 81 is connected to the pressure lever regulating section 73 provided at the front end portion of the subsequent retaining portion 71.

In FIG. 8B, in the right side retaining portion 71, one end portion of the linking portion 81 is connected to a rear portion of the main body section 72, and another end portion of the linking portion 81 is connected to the separation lever regulating section 74 provided at the rear end portion of the front side retaining portion 71.

(2) Attached State of Spacer Member 70 to Drum Unit 3

Figure 11:
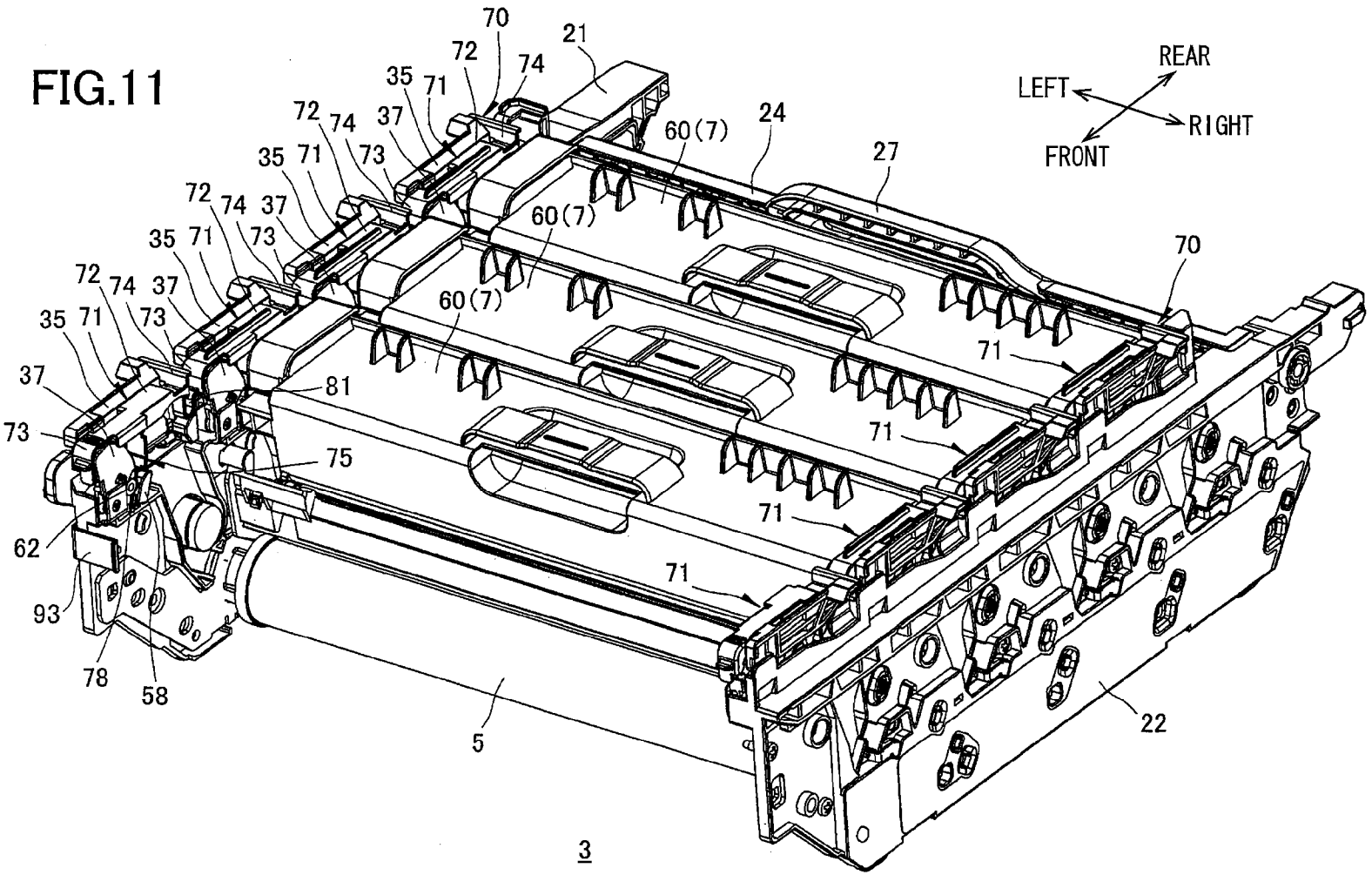
FIG. 11 is a perspective view of the drum unit provided with the spacer member and the fixing member according to the embodiment.

As shown in FIG. 11, each retaining portion 71 is in confrontation with each developer cartridge 7 in the lateral direction in the attached state of the spacer members 70 to the drum unit 3. Each linking portion 81 is positioned in each space defined between neighboring developer cartridges 7.

In this state, each spacer body 78 of each spacer section 75 is interposed between each boss 62 of each developer cartridge 7 and each acting portion 58 of each separation lever 35. Further, the boss 62 is engaged with the arcuate recessed portion 79 formed at a front side of the spacer body 78. Therefore, the boss 62 is displaced to be spaced away from the separation lever 35 by a thickness of the spacer body 78, thereby maintaining a spaced position of the developer cartridge 7.

The pressure lever 37 is pushed upward by the boss 62 because of the displacement thereof. On the other hand, the pressure lever regulating section 73 prevents the pressure lever 37 from pivotally moving upward, since the pressure lever regulating section 73 is positioned immediately above and frontward of the pressure lever 37 and in contact with the upper end portion and front end portion of the pressure lever 37. Therefore, position of the boss 62 is fixed with being interposed between the spacer section 75 and the pressure lever 37.

Further, the acting portion 58 of the separation lever 35 is urged downward by the spacer body 78, therefore, the separation lever 35 is positioned at the second position spaced away from the boss 62. On the other hand, the separation lever regulating section 74 prevents the separation lever 35 from pivotally moving in a direction such that the rear end portion of the separation lever 35 is urged rearward, i.e., the acting portion 58 is urged upward, since the separation lever regulating section 74 is in contact with the rear end portion of the separation lever 35 from rearward.

Further, although not shown in FIG. 11, the drop-out preventing sections 76 (FIG. 8A) are in contact with the separation levers 35 from laterally outward in the assembling state of the spacer member 70 to the drum unit 3. On the other hand, the main body sections 72 of the retaining portions 71 are in contact with the separation lever 35 from laterally inward. That is, the separation lever 35 is nipped between the drop-out preventing section 76 and the main body section 72 in the lateral direction. Therefore, lateral displacement of the spacer member 70 is restrained to avoid release of the spacer member 70 from the drum unit 3.

Figure 12:
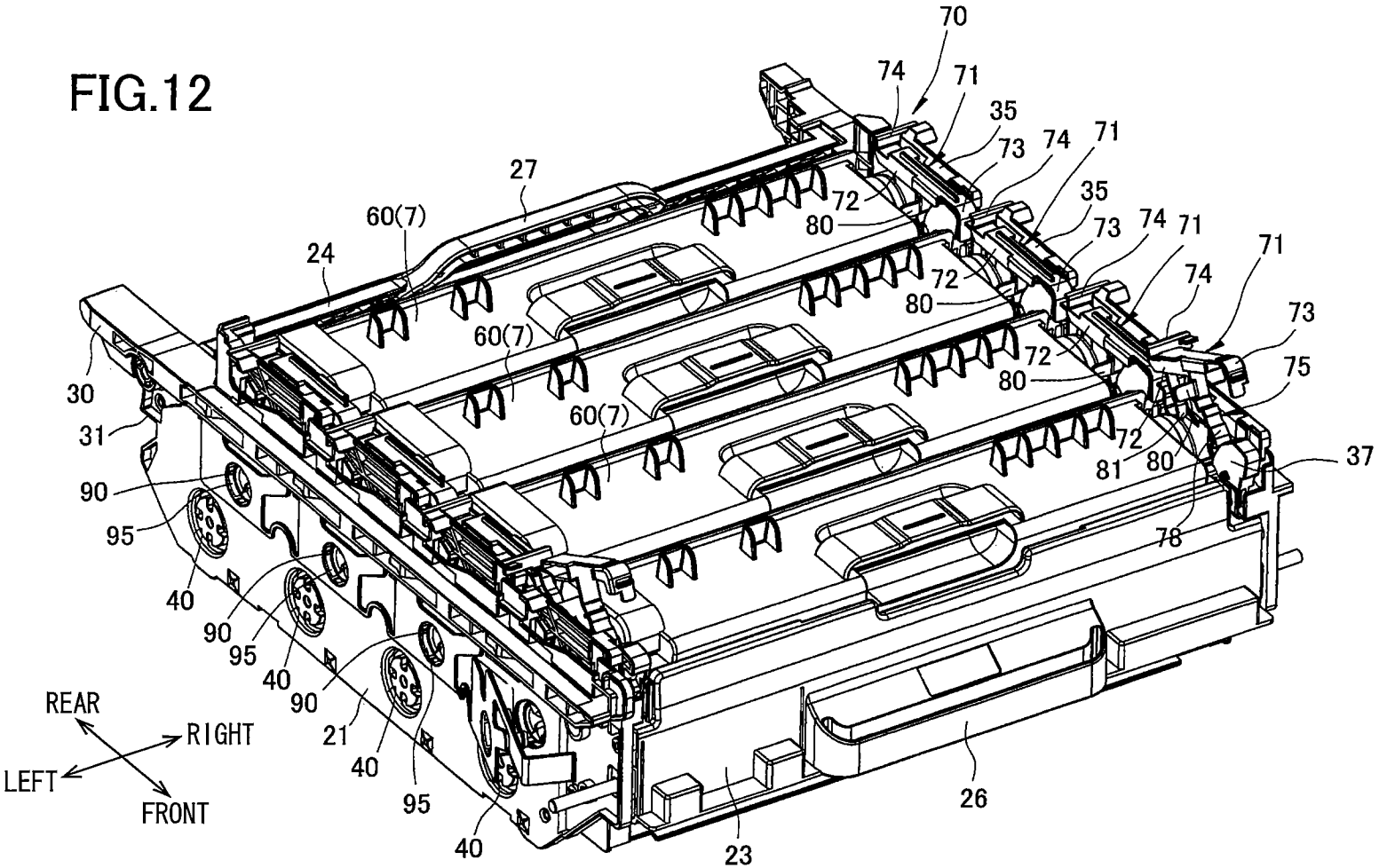
FIG. 12 is a perspective view of the drum unit showing detaching state of the spacer member and the fixing member according to the embodiment.

Further, as shown in FIG. 12, each restraining portion 80 provided at each retaining portion 71 of the right spacer member 70 is in contact with each toner case 60 from rightward. Therefore, each developer cartridge 7 is urged leftward, thereby positioning the developer cartridge 7 in the lateral direction (in an axial direction of the developer cartridge 7).

Further, in this state, the spacer member 70 does not protrude upward from the drum unit 3. That is, as viewed in the lateral direction, the spacer member 70 is not positioned to exceed upward from the upper end portion of the drum unit 3, but the profile of the spacer member 70 does not exceed the upper end portion of the drum unit 3. Accordingly, no mechanical interference occurs between the spacer member 70 and components in the main body casing 2 during attachment and detachment of the drum unit 3 into and from the main body casing 2.

(3) Detaching Operation of the Spacer Member 70

As shown in FIG. 12, for detaching the spacer member 70 from the drum unit 3, the frontmost pressure lever regulating section 73 of the retaining portion 71 is pulled upward. In accordance with the upward displacement of the pressure lever regulating section 73, the front end portion of the main body section 72 of the frontmost retaining portion 71 is lifted upward to tilt the main body section 72. Accordingly, the upper end portion of the spacer section 75 provided at the intermediate portion of the main body section 72 is pulled rearward, so that the spacer section 75 is moved diagonally upward and rearward. Consequently, the spacer body 78 is pulled out from a space between the boss 62 and the acting portion 58 of the separation lever 35 to provide the state shown in FIG. 12.

Then, the boss 62 is pushed downward by the pressure lever 37, so that the associated developer cartridge 7 is moved to the contact position where the developing roller 8 is in contact with the photosensitive drum 5. Further, the main body section 72 is moved upward, and the separation lever regulating section 74 is released from the separation lever 35 to render the separation lever 35 to be free from the separation lever regulating section 74.

In this case, in accordance with an increase in inclination angle of the main body section 72, the linking portion 81 connected to the frontmost retaining portion 71 is resiliently deformed such that one end portion of the linking portion 81 is moved toward the other end portion thereof. Accordingly, a force required for detaching the frontmost retaining portion 71 is not transmitted to the subsequent retaining portion 71. Therefore, the force is only imparted on the frontmost retaining portion 71, while the remaining retaining portions 71 are left unchanged.

After the frontmost retaining portion 71 is detached from the drum unit 3, the frontmost retaining portion 71 is further pulled, so that the one end portion of the linking portion 81 is pulled away from the other end portion thereof. Upon stretching the frontmost linking portion 81, the pulling force can be transmitted to the subsequent retaining portion 71 connected to the other end portion of the frontmost linking portion 81. Thus, similar to the frontmost retaining portion 71, the subsequent retaining portion 71 is detached from the drum unit 3, and then, the third and fourth retaining portions 71 are similarly detached.

5. Fixing Member

As shown in FIG. 3, a fixing member 90 is attached to the first side plate 21 of the drum unit 3, (1) Structure of the Fixing Member 90

Figure 9:
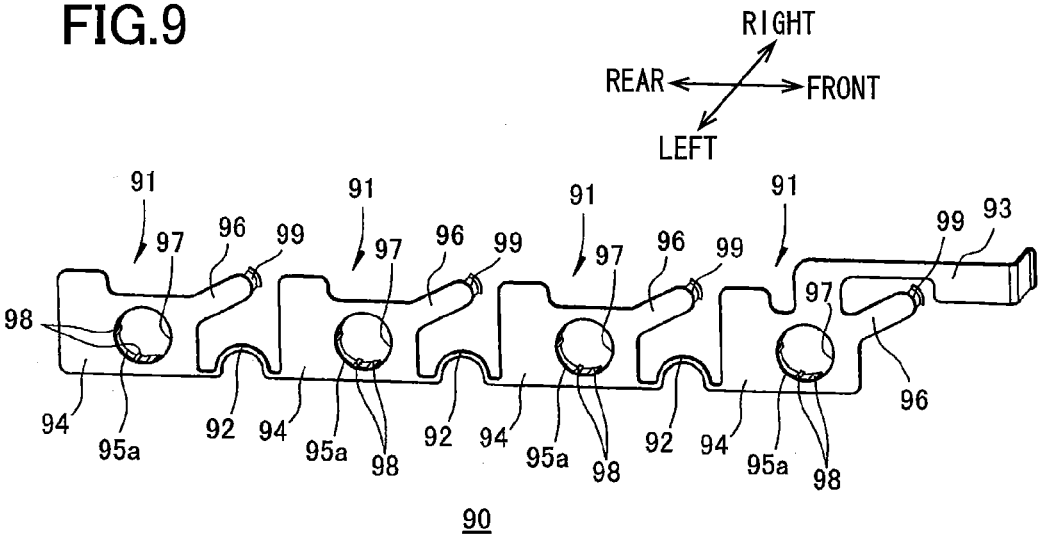
FIGS. 9 and 10 are perspective views of the fixing member according to the embodiment.
Figure 10:
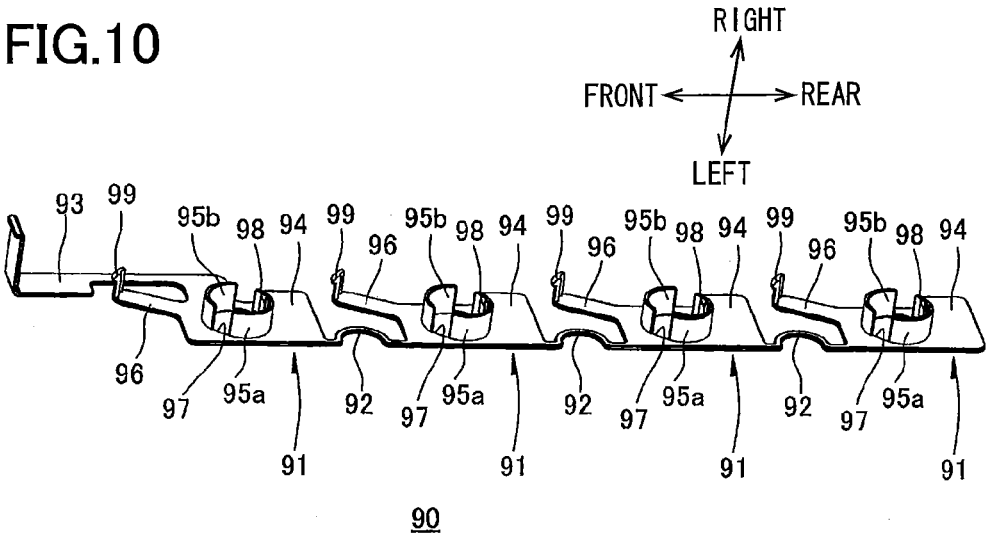

The fixing member 90 is made from a flexible material, and as shown in FIGS. 9 and 10, the fixing member 90 includes four intervenient portions 91, three connecting portions 92 and a single operating portion 93 those being integrally formed.

(1-1) Intervenient Portion 91

Each intervenient portion 91 includes a main section 94, an insertion section 95*a*, 95*b* integrally with the main section 94, and an engaging section 96 integrally with the main section 94.

The main section 94 has generally a rectangular shape extending in frontward/rearward direction and vertical direction. A circular retaining hole 97 extending through a thickness of the main section 94 is formed at a center portion of the main section 94.

The insertion sections 95*a*, 95*b* extend laterally inward from a contour of the retaining hole 97, so that these insertion sections 95*a*, 95*b* have arcuate shape in a side view and spaced away from each other in a circumferential direction of the retaining hole 97.

Each retaining hole 97 is aligned with each developer coupling insertion hole 41 when the fixing member 90 is attached to the first side plate 21. One of the insertion sections 95*a* is positioned in the developer coupling insertion hole 41 and closer to the drum coupling insertion hole 40 than the remaining insertion section 95*b* to the drum coupling insertion hole 40 in the attached state of the fixing member 90 to the first side plate 21. That is, one of the insertion section 95*a* is positioned, in a side view, at a side where the developing roller 8 is positioned proximate to the photosensitive drum 5. The insertion section 95*a* has a radially inner surface provided with a plurality of ribs 98.

The remaining insertion section 95*b* is positioned in the developer coupling insertion hole 41 and farther from the drum coupling insertion hole 40 than the insertion section 95*a* from the drum coupling insertion hole 40. That is, the remaining insertion section 95*b* is positioned, in a side view, at a side of the developing roller 8 away from the photosensitive drum 5.

The engaging section 96 extends frontward and diagonally upward from a front upper corner portion of the main section 94. The engaging section 96 has a free end portion provided with an engagement projection 99 protruding laterally inward (rightward).

(1-2) Connecting Portion 92

Each connecting portion 92 is positioned between the intervenient portions 91 arrayed in frontward/rearward direction, and has an inverted U-shape configuration where a lower end is open. On end portion of the connecting portion 92 is connected to a rear end portion of the front side intervenient portion 91, and another end portion of the connecting portion 92 is connected to a front end portion of the subsequent intervenient portion 91.

(1-3) Operating Portion 93

The operating portion 93 is connected to the frontmost main section 94. The operating portion 93 extends upward from an upper end portion of the main section 94, and is then bent frontward over the front edge of the main section 94, and is then bent laterally inward (rightward). The frontward extending portion of the operating portion 93 is shaped to avoid mechanical interference with the engaging section 96.

(2) Attaching State of the Fixing Member 90 to the Drum Unit 3

As shown in FIGS. 11 and 12, in a state where the fixing member 90 is attached to the drum unit 3, each intervenient portion 91 is in confrontation with each developer cartridge 7, and each connecting portion 92 is positioned in each space defined between the neighboring developer cartridges 7.

In this state, each retaining hole 97 is positioned in alignment with each developer coupling insertion hole 41. Further, each two insertion sections 95*a*, 95*b* are interposed between the developer coupling insertion hole 41 and the developer coupling 42. That is, each two insertion sections 95*a*, 95*b* are positioned internal of the developer coupling insertion hole 41 and external of the developer coupling 42.

The developer coupling 42 is lifted by the plurality of ribs 98 provided at the insertion section 95*a*. Accordingly, the developer cartridge 7 is positioned so that the developing roller 8 is spaced away from the photosensitive drum 5. Further, displacement of the developer coupling 42 in the diagonally frontward and upward direction can be prevented by the remaining insertion section 95*b* since the insertion section 95*b* is positioned diagonally upward and frontward of the developer coupling 42. Thus, the elevated position of the developer coupling 42 by the plurality of ribs 98 can be fixed.

Further, each engagement projection 99 of each engaging section 96 is inserted into each light transmission hole 43 (FIG. 5), so that the engaging section 96 is supported to the first side plate 21.

The operating portion 93 sneaks around to the front side of the first side plate 21 and is in abutment with the first side plate 21.

Further, in this state, the external surface (left side surface) of the fixing member 90 extends along the first side plate 21. Therefore, no mechanical interference occurs between the fixing member 90 and the internal components in the main body casing 2 when the drum unit 3 is assembled in or detached from the main body casing 2.

(3) Detaching Fixing Member 90 from Drum Unit 3

For detaching the fixing member 90 from the drum unit 3, the front end portion of the operating portion 93 is pulled leftward. By this pulling, the main section 94 is deformed to provide an inclination such that its front end portion is moved away from the first side plate 21. Therefore, the engaging section 96 connected to the front end portion of the main section 94 is moved leftward. Thus, the engagement projection 99 of the engaging section 96 is disengaged from the first side plate 21.

Further, the two insertion sections 95*a*, 95*b* are pulled out of the developer coupling insertion hole 41 of the first side plate 21. Accordingly, the developer coupling 42 is brought into abutment with the lower end portion of the developer coupling insertion hole 41, so that the developer cartridge 7 is moved to the contact position where the developing roller 8 is in contact with the photosensitive drum 5.

After the frontmost intervenient portion 91 is detached from the first side plate 21, the front end portion of the operating portion 93 is further pulled in a direction perpendicular to the frontward/rearward direction. As a result, the pulling force is transmitted to the second intervenient portion 91 through the connecting portion 92. Consequently, the second intervenient portion 91 is similarly detached from the first side plate 21, and in the same way, the third and fourth intervenient portions 91 can be removed from the first side plate 21.

6. Operation and Effect

As described above, four photosensitive drums 5 are juxtaposed with a space between neighboring photosensitive drums 5 in the frontward/rearward direction in the drum unit 3, and each developer cartridge 7 is provided for each photosensitive drum 5. Each developer cartridge 7 is accommodated in the drum unit 3 and displaceable between the contact position and the spaced position. In the contact position, the developing roller 8 of the developer cartridge 7 is in contact with the photosensitive drum 5, and in the spaced position the developing roller 8 is spaced away from the photosensitive drum 5.

Further, the retaining portion 71 is provided for each developer cartridge 7, so that each developer cartridge 7 can be held at the spaced position by the retaining portion 71. Accordingly, the printer 1 can be transported with maintaining a spaced state between the photosensitive drum 5 and the developing roller 8. Consequently, frictional contact between the photosensitive drum 5 and the developing roller 8 does not occur during transportation in spite of application of vibration to the printer 1. Thus, injury or damage to the surface of the photosensitive drum 5 can be avoided.

Further, since neighboring retaining portions 71 are connected to each other through the linking portion 81, the spacer member 70 can be promptly removed from the drum unit 3 by way of a single pulling operation. Thus, detachment of the spacer member 70 does not require much labor.

Further, since the linking portion 81 is made from the flexible material stretchable and shrinkable in the frontward/rearward direction. Therefore, a distance between the neighboring retaining portions 71 can be finely adjusted by the deformation of the linking portion 81. Consequently, each retaining portion 71 can be easily positioned at a position to provide the spaced position of each developer cartridge 7.

Further, the developer cartridges 7 are arrayed in parallel to each other with a predetermined space in the frontward/rearward direction, and the linking portion 81 is U-shaped extending downward between the neighboring developer cartridges 7. Since each linking portion 81 can be positioned at the space between the neighboring developer cartridges 7, no additional space for setting the linking portion 81 is required.

Further, since the linking portion 81 has the U-shape, the linking portion 81 can be stretched or shrunk in the frontward/rearward direction by altering a distance between free ends of the U-shape.

Further, the developing roller 8 is held in the toner case 60 of the developer cartridge 7, and each toner case 60 is provided with the boss 62.

Further, the plurality of separation levers 35 corresponding to the bosses 62 of the developer cartridges 7 are provided in the drum unit 3. The boss 62 is pressed by the separation lever 35 to move the developer cartridge 7 to the spaced position by positioning the separation lever 35 at the first position. The separation lever 35 is moved away from the boss 62 to provide a space between the boss 62 and the separation lever 35 by positioning the separation lever 35 at the second position.

The retaining portion 71 is provided with the spacer section 75. The boss 62 is pushed by the spacer section 75 to move the developer cartridge 7 to the spaced position when the spacer section 75 is positioned in the space between the boss 62 and the separation lever 35. Thus, the developer cartridge 7 can be positioned at the spaced position.

Further, the spacer section 75 extends linearly. Therefore, the spacer section 75 can be pulled out from the space between the separation lever 35 and the boss 62 by moving the spacer section 75 in the extending direction thereof.

Further, the pressure levers 37 are displaceable. The developing roller 8 is pushed toward the photosensitive drum 5 when the boss 62 is pushed by the pressure lever 37.

Displacement of the pressure lever 37 is restrained by the pressure lever regulating section 73 in the state where the developer cartridge 7 is held at the spaced position. Further in this state, the boss 62 presses the pressure lever 37 when the spacer section 75 is positioned between the boss 62 and the separation lever 35. Accordingly, position of the boss 62 is fixed while the boss 62 is nipped between the pressure lever 37 and the spacer section 75. Consequently, the developer cartridge 7 can be held at the spaced position through the boss 62, preventing the developer cartridge 7 from being released from the drum unit 3.

Further, displacement of the separation lever 35 from its second position to the first position can be restrained by the separation lever regulating section 74 when the separation lever 35 is at the second position. Therefore, the separation lever 35 is held at the second position while the spacer member 70 is attached to the drum unit 3, thereby avoiding rattling of the separation lever 35.

Further, the retaining portion 71 is provided with the restraining portion 80 in contact with the developer cartridge 7, thereby avoiding displacement of the developer cartridge 7 in the lateral direction (axial direction of the developing roller 8). Thus, the developer cartridge 7 can be stably positioned in the lateral direction to avoid rattling of the developer cartridge 7.

Further, the spacer member 70 is provided at each lateral end of the developer cartridge 7. Therefore, spaced position of the developer cartridge 7 can be maintained at each end of the developer cartridge 7, so that a contact between the photosensitive drum 5 and the developing roller 8 can be prevented over the entire lateral length of the photosensitive drum 5 and the developing roller 8.

Further, the drum unit 3 can be pulled out from the main body casing 2 in the frontward/rearward direction. Here, the upper edge of each spacer member 70 is generally along the flat plane of the drum unit extending in the frontward/rearward direction. Therefore, mechanical interference of the spacer member 70 against components in the main body casing 2 can be prevented when pulling our or pushing in the drum unit 3 relative to the main body casing 2.

7. Modified Embodiment

Various modifications may be conceivable. For example, in the above-described embodiment, two insertion sections 95*a*, 95*b* are provided. However, the fixing member 90 at least requires the insertion section 95*a*, and the other insertion section 95*b* can be dispensed with.

Figure 13:
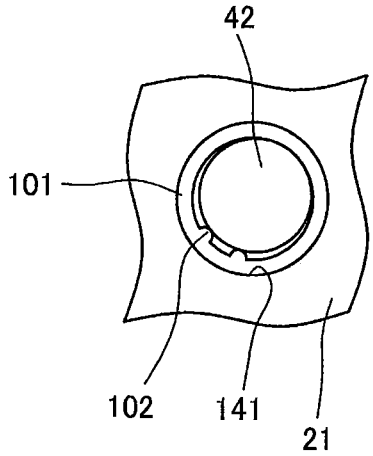
FIG. 13 is an enlarged view showing a part of a first side plate according to a modified embodiment.

Further, as shown in FIG. 13, a separate sleeve member 101 is fitted in a developer coupling insertion hole 141 having a circular cross-section. The sleeve member 101 has an outer diameter approximately equal to an inner diameter of the developer coupling insertion hole 141, and has an inner diameter slightly greater than an outer diameter of the developer coupling 42.

Ribs 102 are formed in the inner surface of the sleeve member 101 at a position adjacent to the drum coupling insertion hole 40 (FIG. 2). By the ribs 102, the developer coupling 42 inserted in the sleeve member 101 can be set at the spaced position spaced away from the photosensitive drum 5.

While the invention has been described in detail with reference to the embodiments thereof, it would be apparent to those skilled in the art that various changes and modifications may be made therein without departing from the spirit of the invention.

What is claimed is:

1. An image forming device comprising:

a plurality of photosensitive drums;

a holder unit configured to hold the plurality of photosensitive drums such that the plurality of photosensitive drums are arrayed in a predetermined direction and juxtaposed with each other with a space between neighboring photosensitive drums;

a plurality of developing units held by the holder unit, each being provided in association with each photosensitive drum, and each including a developing roller displaceable between a contact position where the developing roller is in contact with the photosensitive drum and a spaced position where the developing roller is spaced away from the photosensitive drum; and, a spacer member having a plurality of retaining portions each in association with each developing unit and configured to retain each developing unit at the spaced position, and a linking portion integral with the retaining portions and configured to connect neighboring retaining portions therethrough in the predetermined direction, wherein the linking portion provides flexibility and is shrinkable and stretchable in the predetermined direction.

2. The image forming device as claimed in claim 1, wherein the plurality of developing units are arrayed in the predetermined direction and juxtaposed with each other with a space between neighboring developing units, and wherein the linking portion has a U-shaped configuration extending in a direction crossing the predetermined direction at a position between neighboring developing units.

3. The image forming device as claimed in claim 1, wherein each developing unit comprises a casing supporting the developing roller, and a pressed portion protruding from the casing;

wherein the image forming device further comprises a plurality of separation levers provided at the holder unit and each being in association with each developing unit, and each being movable between a first position where each separation lever presses the pressed portion to position each developing unit at the spaced portion and a second position where each separation lever is spaced away from each pressed portion; and wherein each retaining portion has a spacer section interposed between each separation lever and each pressed portion to hold each developing unit at the spaced position when the separation lever is at the second position.

4. The image forming device as claimed in claim 3, wherein each spacer section extends linearly in a direction crossing the predetermined direction.

5. The image forming device as claimed in claim 3, further comprising a plurality of pressure levers provided at the holder unit, each pressure lever being displaceable relative to each developing unit to press the pressed portion toward each photosensitive drum; and wherein each retaining portion includes a pressure lever regulating section configured to restrain displacement of each pressure lever when the developing unit is held at the spaced position.

6. The image forming device as claimed in claim 3, wherein each retaining portion includes a separation lever regulating section configured to prevent the separation lever from displacing from the second position to the first position when the separation lever is at the second position.

7. The image forming device as claimed in claim 1, wherein each retaining portion has a restraining portion in contact with each developing unit to prevent each developing unit from moving in an axial direction of the developing roller.

8. The image forming device as claimed in claim 1, wherein the developing unit has one end and another end in an axial direction of the developing roller, the spacer member being positioned at each end of the developing unit.

9. The image forming device as claimed in claim 1, further comprising a main body casing to which the holder unit is assembled, the holder unit being pulled out relative to the main body casing in the predetermined direction, and wherein the holder unit has a flat surface extending in the predetermined direction, the spacer member having an upper surface extending along the flat surface.

* * * * *

UNITED STATES PATENT AND TRADEMARK OFFICE

CERTIFICATE OF CORRECTION

PATENT NO. : 8,483,593 B2
APPLICATION NO. : 13/009096
DATED : July 9, 2013
INVENTOR(S) : Okabe et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 225 days.

Signed and Sealed this
Fourth Day of November, 2014

Michelle K. Lee

Michelle K. Lee
*Deputy Director of the United States Patent and Trademark Office*